US009382712B2

(12) United States Patent
Weber et al.

(10) Patent No.: US 9,382,712 B2
(45) Date of Patent: Jul. 5, 2016

(54) WALL CONSTRUCTION SYSTEM AND COMPONENT THEREOF

(71) Applicants: Mark R. Weber, Chicago, IL (US); James Kirk, Crown Point, IN (US)

(72) Inventors: Mark R. Weber, Chicago, IL (US); James Kirk, Crown Point, IN (US)

( * ) Notice: Subject to any disclaimer, the term of this patent is extended or adjusted under 35 U.S.C. 154(b) by 0 days.

(21) Appl. No.: 14/264,968

(22) Filed: Apr. 29, 2014

(65) Prior Publication Data

US 2015/0308114 A1 Oct. 29, 2015

(51) Int. Cl.
*E04B 2/02* (2006.01)
*E04C 1/40* (2006.01)

(52) U.S. Cl.
CPC .... *E04C 1/40* (2013.01); *E04B 2/02* (2013.01)

(58) Field of Classification Search
CPC ..... E04B 2/20; E04B 2/26; E04B 2/14; E04B 2/02; E04B 2/06; E04B 2/10; E04B 2/24; E04B 2002/0243; E04B 2002/023
USPC ..... 52/592.5, 592.6, 582.1, 589.1, 592.1, 52/578, 580, 592.3, 591.1, 606, 605, 438, 52/421, 439, 442, 562, 424, 432, 565, 699, 52/428
See application file for complete search history.

(56) References Cited

U.S. PATENT DOCUMENTS 641,067 A 1/1900 Blazo
1,717,546 A * 6/1929 Bemis ..... 52/259
2,453,466 A * 11/1948 Slobodzian ..... E04B 2/26 52/307
3,166,873 A * 1/1965 Rosenfeld ..... 52/439
3,221,458 A 12/1965 Lucas
3,430,403 A 3/1969 Muse
3,479,782 A 11/1969 Muse
3,609,926 A 10/1971 Muse
3,680,277 A 8/1972 Martin
3,693,307 A 9/1972 Muse
3,780,484 A 12/1973 Muse
4,091,587 A * 5/1978 Depka ..... 52/421
4,110,949 A 9/1978 Cambiuzzi et al.
4,115,980 A 9/1978 Martel et al.
4,936,062 A * 6/1990 Golston et al. ..... 52/127.1
5,048,250 A 9/1991 Elias
5,241,795 A 9/1993 Giroux et al.
5,596,857 A * 1/1997 Besche ..... E04B 2/48 52/100
5,839,249 A 11/1998 Roberts
6,996,945 B2 2/2006 Doty
2002/0112437 A1 * 8/2002 Queen ..... 52/677
2003/0121231 A1 * 7/2003 Hinds ..... 52/677
2010/0212247 A1 * 8/2010 Kohl et al. ..... 52/565
2013/0247497 A1 * 9/2013 Toopchinezhad ..... B28B 7/183 52/565

FOREIGN PATENT DOCUMENTS

WO WO8102908 A1 * 10/1981
WO WO8304423 A1 * 12/1983

* cited by examiner

*Primary Examiner* — Brian Glessner
*Assistant Examiner* — Babajide Demuren
(74) *Attorney, Agent, or Firm* — McCracken & Gillen LLC

(57) ABSTRACT

A wall construction system includes a first block having a first surface and a first void and a second block having a second surface and a second void. The second block is positioned atop the first block to define an interface plane at the adjacent first and second surfaces. The wall construction system further includes a shear member encased within cementitious material within the first and second voids at the interface plane. The cementitious material engages opposing walls of the first and second voids.

17 Claims, 7 Drawing Sheets

WALL CONSTRUCTION SYSTEM AND COMPONENT THEREOF

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

FIELD OF DISCLOSURE

The present subject matter relates to construction materials, and more particularly, to a system for constructing a wall.

BACKGROUND

Typical concrete wall structures are fabricated using concrete masonry units (CMU's—otherwise referred to as concrete blocks) that are positioned in courses atop a foundation and joined to one another by mortar. Ordinary CMU's include planar front and rear faces and, often, two or three spaced webs extending between the front and rear faces. The webs define one or two voids extending fully from top to bottom of the CMU. Outermost webs may comprise planar or recessed end faces of the CMU. The CMU is typically formed from cast concrete or other materials.

Building a wall using CMU's is a time-consuming process that is best undertaken by a skilled tradesperson, such as a mason. Once a level foundation has been prepared, the mason must arrange CMU's in level and plumb courses. The process of building is complex because the mason must use mortar both as a positioning and bonding agent. The consistency of the uncured mortar and the strength of the mortar, when dry, have a major impact on the quality and strength of the resulting wall.

SUMMARY

Disclosed is a wall construction system that comprises a first block having a first surface and a first void and a second block having a second surface and a second void. The second surface of the second block is positioned atop the first surface of the first block to define an interface plane between the first and second surfaces. The first and second voids have first and second heights respectively. The wall construction system further comprises a hollow shear member having a first shear surface and a second shear surface opposite the first shear surface. Each of the first shear surface and the second shear surface extends a full height of the shear member, spans the interface plane, extends into the first and second voids, and is contacted by cementitious material disposed in the voids so that the shear member is fully encased within the cementitious material. The cementitious material is disposed within the full height of the shear member and the full height of the shear member is less than the first and second heights. The cementitious material engages opposing walls of the first and second voids and all of the shear member is spaced apart from the opposing walls of the first and second voids.

Also disclosed is a wall construction system that comprises a first block having a first surface and a first void and a second block having a second surface and a second void. The second surface of the second block is positioned atop the first surface of the first block to define an interface plane between the first and second surfaces. The wall construction system further comprises hollow shear member having a first shear surface and a second shear surface opposite the first shear surface. Each of the first shear surface and the second shear surface extends a full height of the shear member, spans the interface plane, extends into the first and second voids, and is contacted by cementitious material disposed in the voids so that the shear member is fully encased within the cementitious material and the cementitious material is disposed within the full height of the shear member. The cementitious material engages opposing walls of the first and second voids and at least a portion of the shear member is spaced apart from the opposing walls of the first and second voids. The shear member is disposed on an insert disposed within the first void.

Further disclosed is a wall construction system that comprises a first block having a first surface and a first void and a second block having a second surface and a second void. The second surface of the second block is positioned atop the first surface of the first block to define an interface plane between the first and second surfaces. The first and second voids have first and second heights respectively. The wall construction system further comprises a shear member having a first shear surface and a second shear surface opposite the first shear surface and extending a full height of the shear member. The shear member is disposed within the first and second voids and spans the interface plane. The full height of the shear member is less than the first and second heights. The wall construction system further comprises a cementitious material engaging opposing walls defining the first and second voids and both the first and second shear surfaces along the full height of the shear member such that the entirety of the shear member is spaced apart from the opposing walls.

Yet further disclosed is a wall construction system that comprises a first block having a first surface and a first void and a second block having a second surface and a second void. The second surface of the second block is positioned atop the first surface of the first block to define an interface plane between the first and second surfaces. The wall construction system further comprises a shear member having a first shear surface and a second shear surface opposite the first shear surface and extending a full height of the shear member. The shear member is disposed within the first and second voids and spans the interface plane. A cementitious material engages opposing walls defining the first and second voids and both the first and second shear surfaces along the full height of the shear member. The shear member is disposed on an insert disposed within the first void.

Also disclosed is a wall construction system that comprises a first block having a first surface and a first void and a second block having a second surface and a second void. The second surface of the second block is positioned atop the first surface of the first block to define an interface plane between the first and second surfaces. The first and second voids have first and second heights respectively. The wall construction system further comprises a shear member having a first shear surface and a second shear surface opposite the first shear surface and extending a full height of the shear member. The shear member is disposed within the first and second voids and spans the interface plane and the full height of the shear member is less than the first and second heights. The wall construction system further comprises means for retaining the shear member within the first and second voids. A cementitious material engages two opposing walls defining the first and second voids and both the first and second shear surfaces along the full height of the shear member such that the entirety of the shear member is spaced apart from the opposing walls.

Other aspects and advantages will become apparent upon consideration of the following detailed description and the attached drawings wherein like numerals designate like structures throughout the specification.

DETAILED DESCRIPTION

Figure 1:
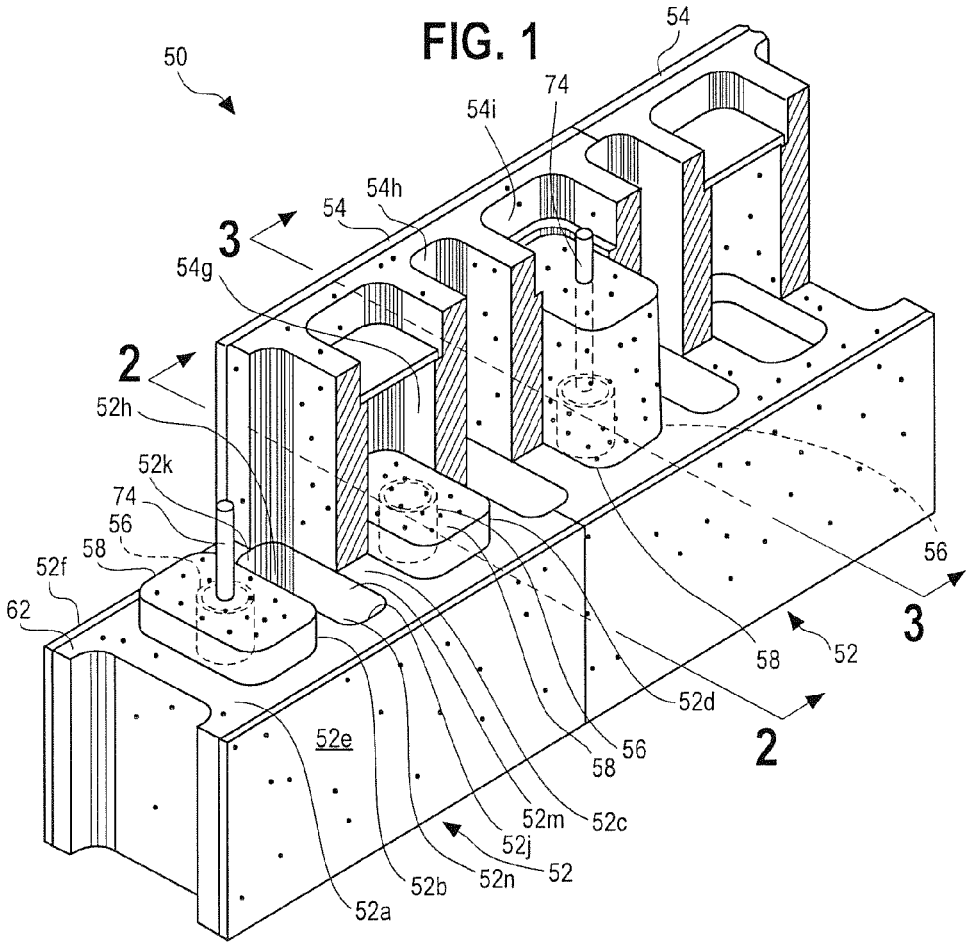
FIG. 1 is a fragmentary isometric view, partly in section, of a wall construction system of the present invention.

Referring to the attached FIGS., the wall construction system 50 of the present invention comprises a first course of blocks 52 and subsequent courses of blocks 54 stacked atop the first course. A shear member 56 is disposed within cementitious material 58 between stacked blocks. The shear member 56, which may be encased in cementitious material 58, may be used with any conventional construction blocks or specialized blocks such as the wall construction system disclosed in U.S. patent application Ser. No. 13/213,361, filed Aug. 19, 2011, entitled "Wall Construction Block Combination for a Wall Construction System", patent application Ser. No. 13/773,302, filed Feb. 21, 2013, entitled "Wall Construction System", patent application Ser. No. 13/958,304, filed Aug. 2, 2013, entitled "Wall Construction Block", and patent application Ser. No. 13/958,322, filed Aug. 2, 2013, entitled "Wall Construction System", the disclosures of which are incorporated by reference herein.

Referring to FIG. 1, the first course comprises a plurality of blocks 52 positioned end-to-end on a prepared surface 60 such as a footing, and the second course comprises a plurality of blocks 54 positioned end-to-end atop the first course of blocks 52. Each block 52, 54 has an 8 inch height, a 16 inch length, and an 8 inch width, although other dimensions may be used as desired. In the embodiment shown in FIG. 1, each of the blocks 52, 54 has four webs 52*a*, 52*b*, 52*c*, 52*d* extending between front and rear faces 52*e*, 52*f*. The webs 52*a*-52*d* and the front and rear faces 52*e*, 52*f* define a number of voids 52*g*, 52*h*, 52*i* (see also FIGS. 2 and 3). Each void 52*g*-52*i* is defined by two pairs of opposing side walls 52*j* and 52*k*, 52*m* and 52*n*. The voids 52*g*-52*i*, 54*g*-54*i* of the first and second blocks 52, 54 can be vertically aligned and filled with cementitious material 58 as described in greater detail below.

The shear member 56 may be positioned in one or more aligned voids of the first and second blocks 52, 54 within the cementitious material 58. In the illustrated embodiment of the wall construction system shown in FIGS. 1-3, a first void 52*g*, 52*i* of a first block 52 having a first surface 62 along the top thereof is aligned with a second void 54*i*, 54*g*, respectively, of the second block 54 having a second surface 64 extending along the bottom thereof. An interface plane 66 (i.e., any plane at which shear forces are experienced once the wall components are constructed) is defined between or by adjacent first and second surfaces 62, 64 of respective first and second blocks 52, 54. The shear member 56 is preferably encased within cementitious material 58 and is positioned at the interface plane 66 within the first and second voids 52*g*, 54*i* and 52*i*, 54*g*. The cementitious material 58 disposed around the shear member 56 engages opposing walls 52/54*j* and 52/54*k*, 52/54*m* and 52/54*n* of the first and second voids 52*g*, 54*i* and 52*i*, 54*g* to form mechanical bonds with the side walls. In some embodiments, the cementitious material 58 may engage additional walls defining the first and second voids 52*g*, 54*i* and 52*i*, 54*g*. Use of the shear member 56 encased in cementitious material 58 augments the shear strength at the interface plane 66. The shear member 56 may be made of steel or other metal, fiberglass, carbon fiber, plastic, or any other material. Further, the shear member 56 and cementitious material 58 are effective to resist shear forces from side to side and/or from front to back of the wall construction system in the horizontal, vertical, and/or any other plane.

Figure 2:
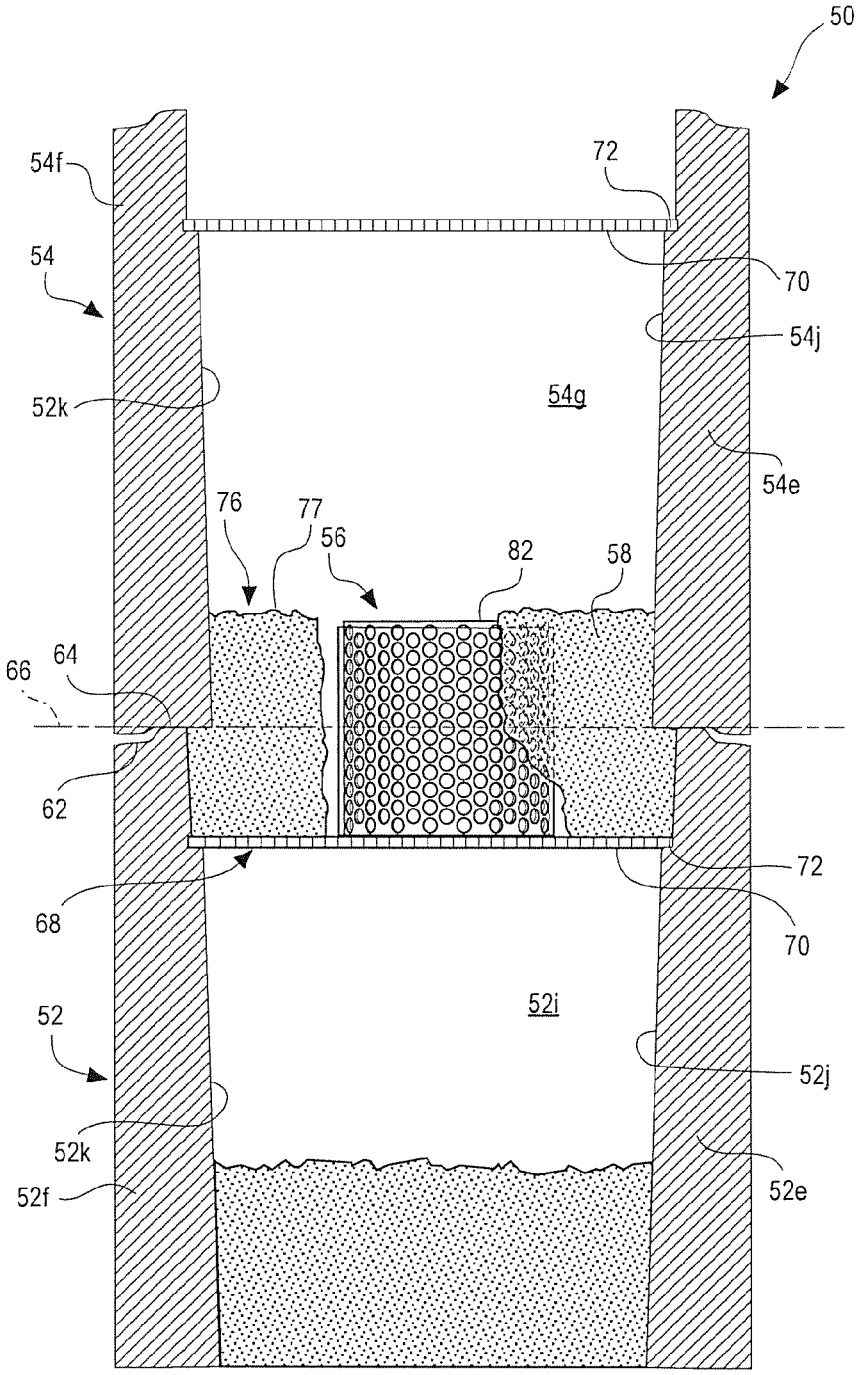
FIG. 2 is a sectional view taken generally along the lines 2-2 of FIG. 1.

In the embodiment shown in FIG. 2, the shear member 56 encased in cementitious material 58 may be disposed atop a planar surface 68 within the first void 52*i*. The planar surface 68 may extend fully from side to side between at least two surfaces 52*j*-52*n* defining the void 52*i*. The top elevation of the planar surface 68 in the void 52*i* is approximately one inch below the first surface 62 of the first block 52. The planar surface 68 may comprise an insert 70 that rests on a ledge 72 formed along the surfaces 52*j*-52*n*. The insert 70 may be positioned atop the ledge 72 spanning the void 52*i* at least partially or, preferably, fully from side to side and between the surfaces 52*j*-52*n*. The insert 70 may be planar or a different shape (such as convex or concave) and may also have a hole or crossing slots or the like in which vertical rebar 74 may be inserted. The insert 70 may be plastic or a similar material that is sufficiently durable to hold uncured grout until curing is complete, and may be approximately 3/16 inch thick. In other embodiments, the planar surface 68 may be formed with the block 52, 54 and comprise a frangible portion that can be knocked out or otherwise removed.

During construction, the user places the first block 52 in position. The shear member 56 may be secured to the planar surface 68 prior to placement, or, if the insert 70 is used, the shear member 56 may be secured to or positioned on the insert 70 after the first block 52 is positioned. Further, the shear member 56 may be positioned in the cementitious material 58 after the cementitious material 58 is disposed atop the insert 70. The second block 54 of the next course is then placed atop the first block 52. Cementitious material 58, such as grout, may be poured in aligned voids 52*i*, 54*g* in the first and second blocks 52, 54 in the successive courses before the insert 70 is placed in the void(s) 54*g*-54*i* in the second block 54 of the subsequent course. A top elevation 77 of the plug 76 after settling is preferably (although not necessarily) about two inches above the planar surface 68 and about one inch above the interface plane 66.

Figure 3:
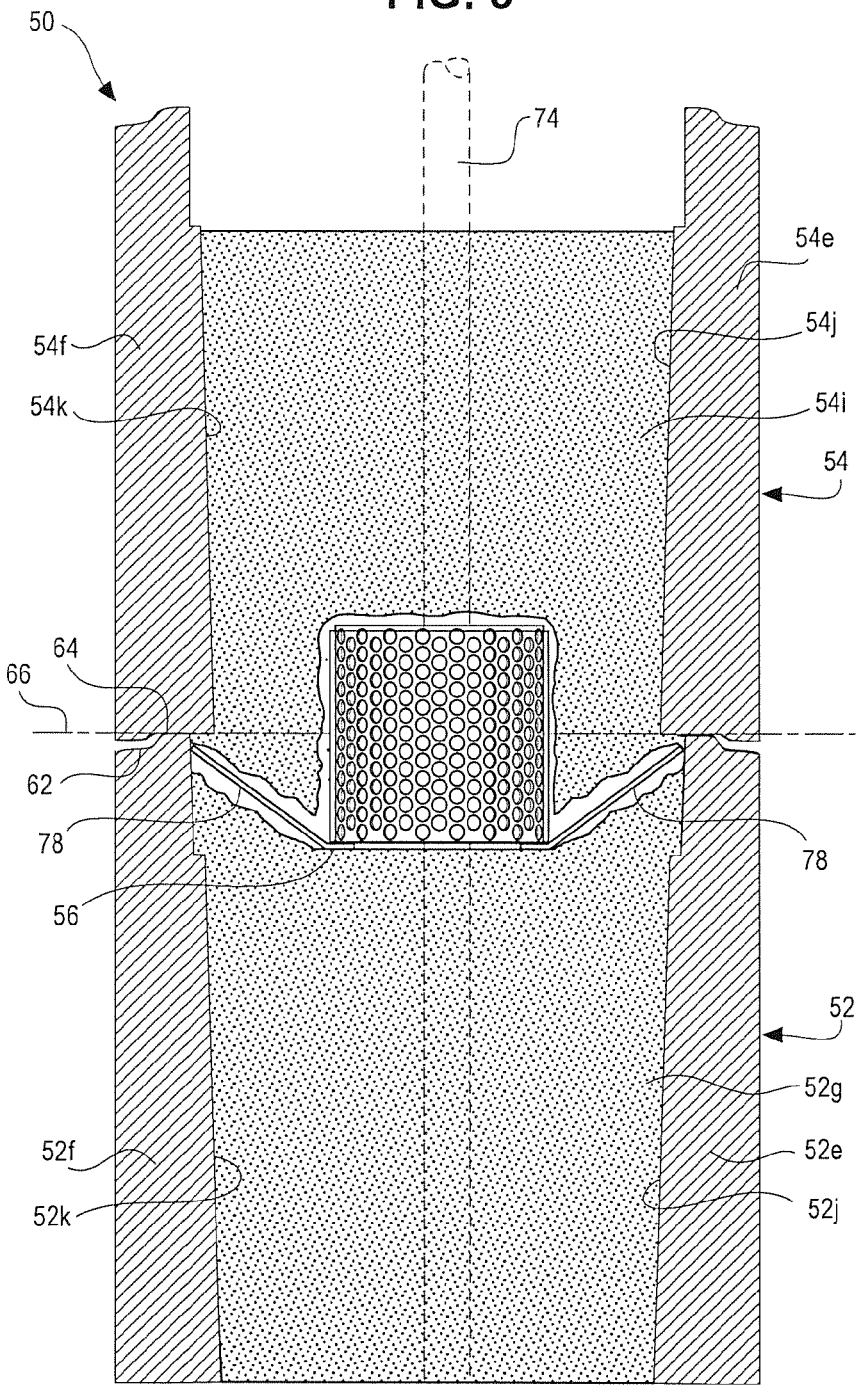
FIG. 3 is a sectional view taken generally along the lines 3-3 of FIG. 1.
Figure 7:
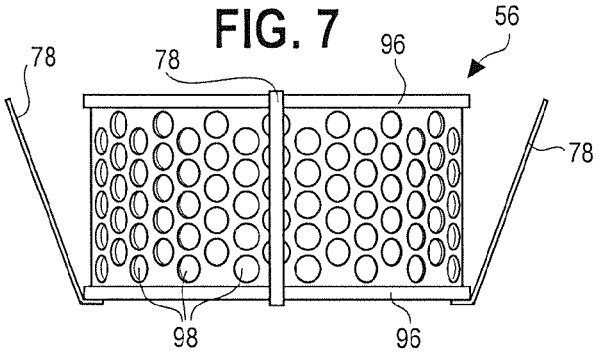
Figure 9:
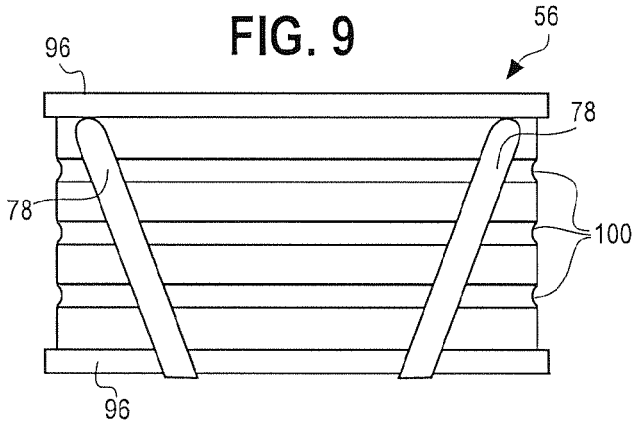

Referring to the embodiment illustrated in FIG. 3, aligned first and second voids 52*g*, 54*i* of the respective first and second blocks 52, 54 may receive vertical rebar 74 and cementitious material 58 to form a solid reinforced wall section. In this embodiment, two or more prongs 78 extending from the shear member 56 to opposing side walls 52*j* and 52*k* of the first void 52*g* maintain the positioning of the shear member 56 relative to the first and second blocks 52, 54, and consequently, the interface plane 66. In a resting state, the prongs 78 extend beyond a distance defined by opposing side walls 52*j* and 52*k* of the void 52*g* such that downward movement of the shear member 56 causes the prongs 78 to exert forces against the opposing side walls 52*j* and 52*k*. Alternatively, tabs, wings, or any combination of tabs, wings, and/or prongs may be disposed along an outer surface of the shear member 56 perpendicular or transverse to edges 96 that exert forces against the opposing side walls 52*j* and 52*k* similar to prongs 78. The prongs 78 or tabs may be secured to the shear member 56 by any means such as, for example, crimping, welding, fusing, melting, through a friction fit, or otherwise joining the prongs 78 or tabs to an edge 96 of the shear member. The prongs 78 or tabs may also extend through perforations 98 described below and be secured thereto by friction fit or any of the above-mentioned other means. Alternatively, the prongs 78 may be integrally formed with the shear member 56, for example, stamped with the shear member 56. The prongs 78 or tabs may comprise any material such as steel or other metal, plastic, or the like. Further, the prongs 78 may all be of the same length or different lengths such that the prongs 78 engage either or both of the voids 52*g*, 54*i*. The prongs 78 of the shear members 56 shown in FIGS. 7 and 9 are dimensioned to engage the void 54*i* of the second block 54, while the prongs 78 of the shear member 56 shown in FIG. 3 engage the void 52*g* of the first block 52.

During construction, the user positions the second block 54 atop the first block 52 such that the first and second voids 52*g*, 54*i* are aligned. The user then pushes the shear member 56 downward into the first and second voids 52*g*, 54*i* at the interface 66. The force of the spring-loaded prongs 78 against the opposing walls 52/54*j* and 52/54*k*, 52/54*m* and 52/54*n* of the first and second voids 52*g*, 54*i* resists the downward movement. Once the shear member 56 is positioned, the user positions the subsequent course of blocks atop the second course, and again positions the shear members 56 within the adjacent voids as desired. After the desired number of courses is laid, the user positions rebar 74 within the shear members 56 of the aligned voids 52*g*-52*i*, 54*g*-54*i* and deposits cementitious material 58 into the aligned voids 52*g*-52*i*, 54*g*-54*i*.

Figure 4:
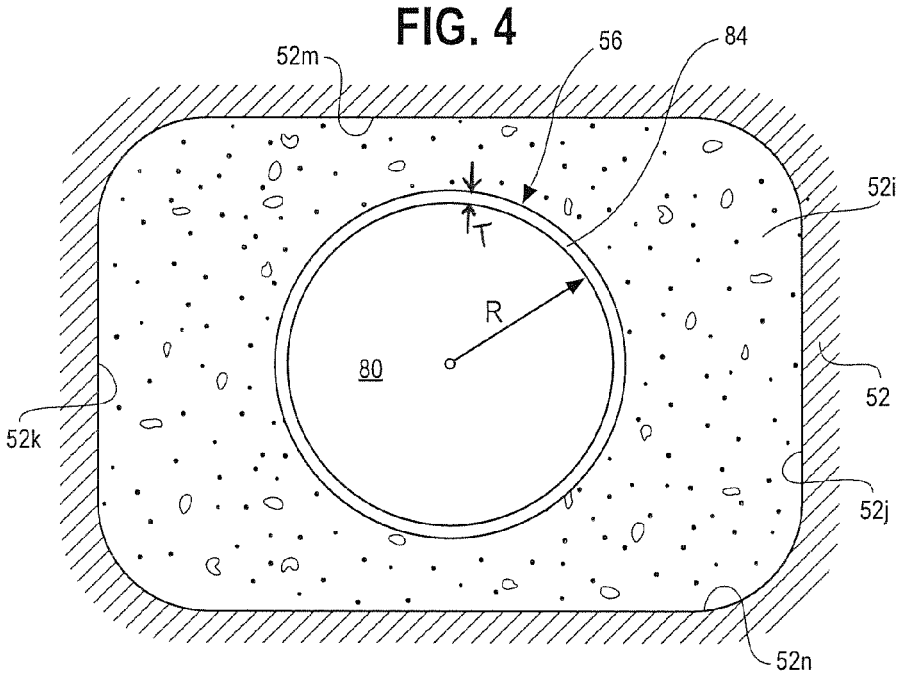
FIG. 4 is a plan view of a void of the wall construction system of FIG. 1.
Figure 5:
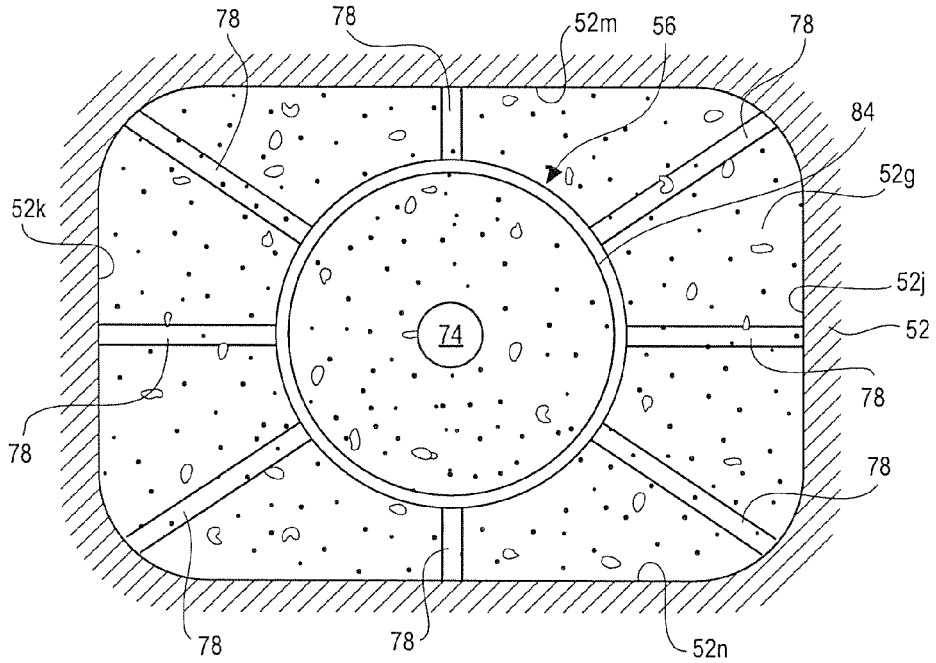
FIG. 5 is a plan view of a further void of the wall construction system of FIG. 1.
Figure 6:
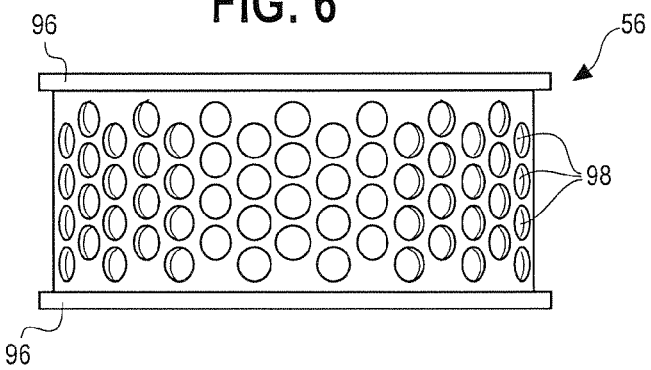
FIG. 6-9 are elevational views of alternative embodiments of a shear member.

As shown in FIGS. 4 and 5, the shear member 56 may include a third void 80 which may optionally be filled with cementitious material 58. The void 80 may be defined by a circle having a radius R of approximately 1.5 inches, although other shapes and dimensions may be used as described below or as required by the size of the block. The shear member 56 may have a height of about 2 to about 3 inches. In other embodiments, it may be preferred to have a greater or lesser height depending on the amount of shear resistance and/or the design of the block and relative components. Further, the shear member 56 may be fully encased within the cementitious material as shown in FIG. 3, while in other embodiments such as that shown in FIG. 2 an upper surface 82 of the shear member 56 may be exposed.

Figure 10:
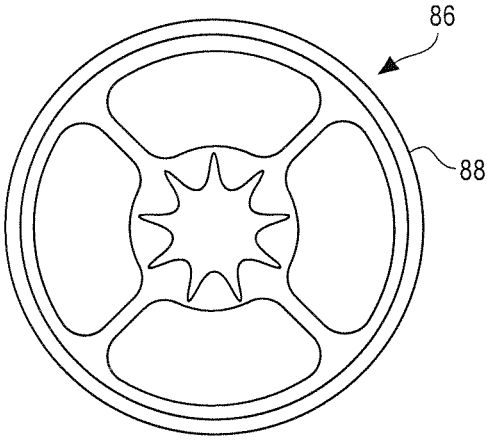
FIG. 10 is a plan view of a centering ring.
Figure 11:
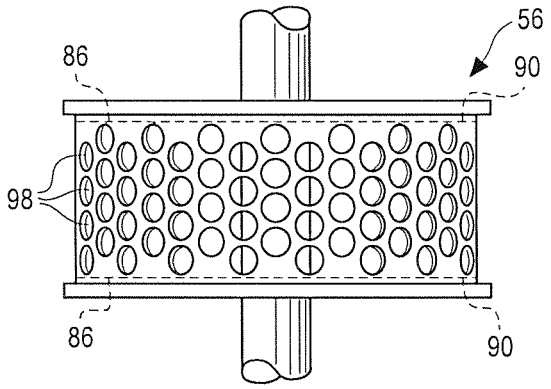
FIGS. 11 and 12 are elevational views of alternative embodiments of a shear member including the centering ring of FIG. 10.
Figure 12:
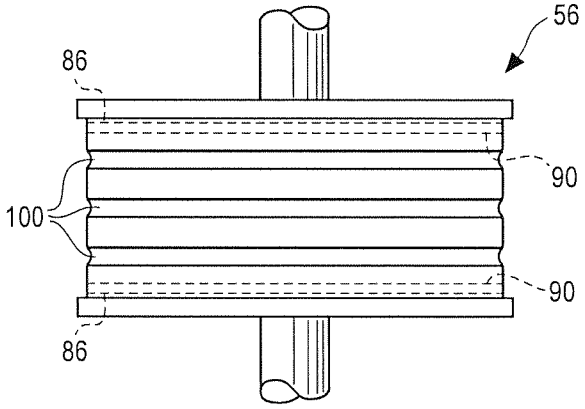
Figure 13:
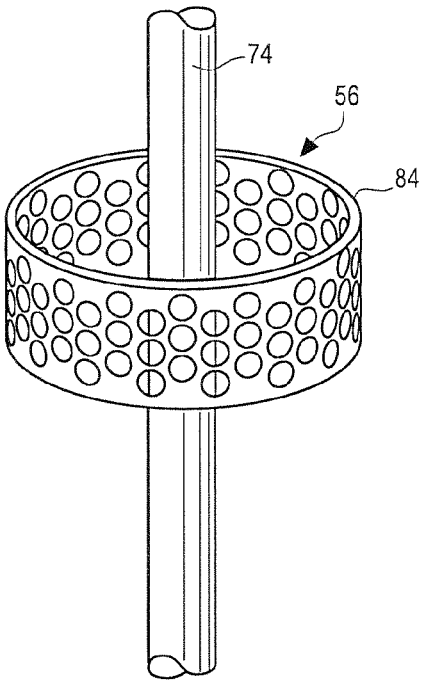
FIGS. 13-15 are isometric views of further alternative embodiments of a shear member.
Figure 14:
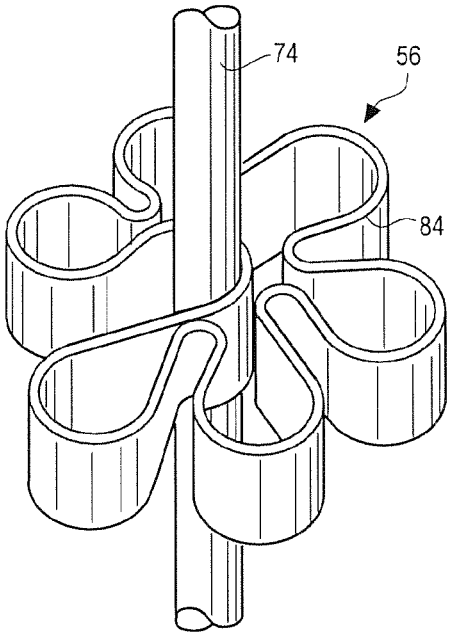
Figure 15:
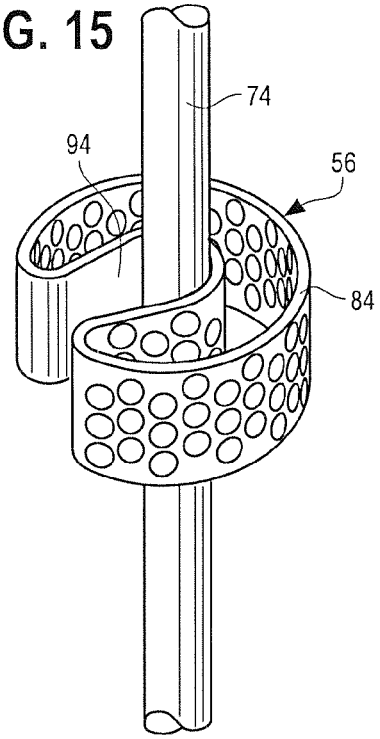

Referring to FIGS. 4, 5, and 13-15, the shear member 56 has a cross-sectional shape 84 along the interface plane 66 that may form a partial or complete loop, although other open or closed shapes/formations may be used as desired. The loop may be annular (FIGS. 4, 5, 10, 11, 13, and 15), undulate (FIG. 14), or any other suitable shape. The loop may have a thickness T between approximately 0.0625 inches and approximately 0.25 inches, although any thickness may be used as desired. Referring to FIGS. 10-12, one or more centering rings 86 may be disposed in the shear member 56 parallel to the interface plane 66 (see FIG. 3) to center vertical rebar 74 (see FIG. 3) within the shear member 56. An outer edge 88 of the centering ring 86 allows the centering ring 86 to snap-fit into a groove 90 along an inner surface of the shear member 56. The centering ring may be made of plastic, steel or other metal, fiberglass, or any other material. In the embodiment shown in FIG. 14, the undulate cross-sectional shape 84 of the shear member 56 has an increased surface area and cross-sectional area. The cross-sectional shape 84 of the shear member 56 relates to the shear strength in that an increased surface area increases the shear strength. As shown in FIG. 15, the cross-sectional shape may include a notch 94 to receive the vertical rebar 74.

Figure 8:
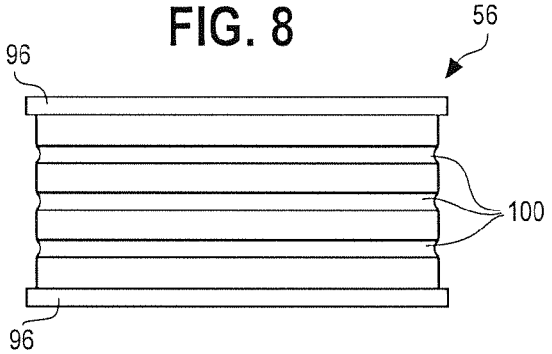

The shear member 56 may be formed with an additional bead of material (forming, e.g., a flange) at the edges 96 thereof as shown in FIGS. 6-9. Further, the shear member 56 may include additional features to strengthen the bond and increase the integration between the shear member 56 and the cementitious material 58. The features may includes perforation(s) 98 (FIGS. 6 and 7), rib(s) 100 (FIGS. 8 and 9), dimples, corrugations, and/or other surface features, texture, and/or pattern. The perforations 98 may have any shape such as a circle, rectangle, slot, strip, or the like, and/or any combination thereof. Referring to FIGS. 8 and 9, the rib 100 may be a concave surface extending into the shear member 56 disposed along an outer and/or inner surface(s) of the shear member 56 at a constant distance from the edges 96. Other formations and shapes, such as a convex surface extending from the shear member 56, forming an undulate or wavy pattern at a distance from the edges 96, and/or extending between the edges 96 perpendicular thereto or at an angle, are envisioned.

It should be noted that the first and second field courses and subsequent courses are arranged to maintain a running bond or other pattern throughout the wall. The wall construction system 50 may include a combination of the embodiments of the shear member 56 encased in cementitious material 58 as described above.

In any of the blocks disclosed herein, fibrous additives and/or other additives or constituents may be incorporated into the concrete during the manufacturing of the block to increase the tensile strength of the block. This increased tensile strength may further contribute to increased resistance to shear forces.

Other embodiments of the disclosure including all the possible different and various combinations of the individual features (including elements and process steps) of each of the foregoing described embodiments and examples are specifically included herein.

INDUSTRIAL APPLICABILITY

In summary, the wall construction system described herein advantageously allows for increased shear strength of stacked blocks in a wall construction system.

All references, including publications, patent applications, and patents, cited herein are hereby incorporated by reference to the same extent as if each reference were individually and specifically indicated to be incorporated by reference and were set forth in its entirety herein.

The use of the terms “a” and “an” and “the” and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only, and should not be taken as limiting the scope of the disclosure.

We claim:

1. A wall construction system, comprising:

a first block having a first surface and a first void;

a second block having a second surface and a second void, wherein the second surface of the second block is positioned atop the first surface of the first block to define an interface plane between the first and second surfaces and wherein the first and second voids have first and second heights, respectively; and a hollow shear member having a first shear surface and a second shear surface opposite the first shear surface wherein each of the first shear surface and the second shear surface extends a full height of the shear member, spans the interface plane, extends into the first and second voids, and is contacted by cementitious material disposed in the voids so that the shear member is fully encased within the cementitious material and the cementitious material is disposed within the full height of the shear member and wherein the full height of the shear member is less than the first and second heights;

wherein the cementitious material engages opposing walls of the first and second voids; and wherein all of the shear member is spaced apart from the opposing walls of the first and second voids.

2. The wall construction system of claim 1, wherein the shear member is perforated.

3. The wall construction system of claim 1, wherein the shear member has a cross-sectional shape along the interface plane that forms a loop.

4. The wall construction system of claim 3, wherein the loop is annular.

5. The wall construction system of claim 1, wherein the cementitious material engages more than the two opposing walls of the voids.

6. A wall construction system, comprising:

a first block having a first surface and a first void;

a second block having a second surface and a second void, wherein the second surface of the second block is positioned atop the first surface of the first block to define an interface plane between the first and second surfaces; and a hollow shear member having a first shear surface and a second shear surface opposite the first shear surface wherein each of the first shear surface and the second shear surface extends a full height of the shear member, spans the interface plane, extends into the first and second voids, and is contacted by cementitious material disposed in the voids so that the shear member is fully encased within the cementitious material and the cementitious material is disposed within the full height of the shear member;

wherein the cementitious material engages opposing walls of the first and second voids; and wherein at least a portion of the shear member is spaced apart from the opposing walls of the first and second voids; and wherein the shear member is disposed on an insert disposed within the first void.

7. A wall construction system, comprising:

a first block having a first surface and a first void;

a second block having a second surface and a second void, wherein the second surface of the second block is positioned atop the first surface of the first block to define an interface plane between the first and second surfaces and wherein the first and second voids have first and second heights, respectively;

a shear member having a first shear surface and a second shear surface opposite the first shear surface and extending a full height of the shear member and disposed within the first and second voids and spanning the interface plane and wherein the full height of the shear member is less than the first and second heights; and a cementitious material engaging opposing walls defining the first and second voids and both the first and second shear surfaces along the full height of the shear member such that the entirety of the shear member is spaced apart from the opposing walls.

8. The wall construction system of claim 7, wherein the shear member is perforated.

9. The wall construction system of claim 7, wherein the shear member has a cross-sectional shape along the interface plane that forms a loop.

10. The wall construction system of claim 9, wherein the loop is annular.

11. The wall construction system of claim 7, wherein the cementitious material engages more than the two opposing walls of the voids.

12. A wall construction system, comprising:

a first block having a first surface and a first void;

a second block having a second surface and a second void, wherein the second surface of the second block is positioned atop the first surface of the first block to define an interface plane between the first and second surfaces;

a shear member having a first shear surface and a second shear surface opposite the first shear surface and extending a full height of the shear member and disposed within the first and second voids and spanning the interface plane; and a cementitious material engaging opposing walls defining the first and second voids and both the first and second shear surfaces along the full height of the shear member;

wherein the shear member is disposed on an insert disposed within the first void.

13. A wall construction system, comprising:

a first block having a first surface and a first void;

a second block having a second surface and a second void, wherein the second surface of the second block is positioned atop the first surface of the first block to define an interface plane between the first and second surfaces wherein the first and second voids have first and second heights, respectively;

a shear member having a first shear surface and a second shear surface opposite the first shear surface and extending a full height of the shear member and disposed within the first and second voids and spanning the interface plane wherein the full height of the shear member is less than the first and second heights;

means for retaining the shear member within the first and second voids; and a cementitious material engaging two opposing walls defining the first and second voids and both the first and second shear surfaces along the full height of the shear member such that the entirety of the shear member is spaced apart from the opposing walls.

14. The wall construction system of claim 13, wherein the shear member is perforated.

15. The wall construction system of claim 13, wherein the shear member has a cross-sectional shape along the interface plane that forms a loop.

16. The wall construction system of claim 15, wherein the loop is annular.

17. The wall construction system of claim 13, wherein the cementitious material engages more than the two opposing walls of the voids.

* * * * *